US005098097A

United States Patent [19]

Kennedy et al.

[11] Patent Number: 5,098,097

[45] Date of Patent: Mar. 24, 1992

[54] FOOTBALL

[75] Inventors: Thomas Kennedy, Chicopee; Joseph F. Baltronis, II, Agawam, both of Mass.

[73] Assignee: Lisco, Inc., Tampa, Fla.

[21] Appl. No.: 669,560

[22] Filed: Mar. 14, 1991

[51] Int. Cl.[5] ..... A63B 41/00

[52] U.S. Cl. ..... 273/65 EC; 273/65 EF

[58] Field of Search ..... 273/65 EC, 65 R, 65 B, 273/65 A, 65 E, 65 ED, 65 EF, 65 EG, 65 F, DIG. 20, 55 R, 58 BA

[56] References Cited

U.S. PATENT DOCUMENTS

| | | | |
|---|---|---|---|
| 1,597,308 | 8/1926 | Brandt | 273/65 EC |
| 1,604,044 | 10/1926 | Hart | 273/65 EC |
| 1,649,458 | 11/1927 | Fewlass | 273/DIG. 20 |
| 3,884,466 | 5/1975 | MacDonald et al. | 273/65 EC |
| 4,003,574 | 1/1977 | MacDonald et al. | 273/65 EC |
| 4,327,912 | 5/1982 | Hoffman | 273/61 D X |
| 4,925,195 | 5/1990 | Di Manno | 273/428 |
| 5,000,451 | 3/1991 | MacDonald et al. | 273/65 EC |

*Primary Examiner*—George J. Marlo

[57] ABSTRACT

An improved American football comprising an inflatable, one piece bladder formed in a generally elliptical shape and fabricated of an elastomeric material; four panels secured together over the bladder, each panel being of a similar, generally oval shape with inturned edges secured together by stitching to form four seams; an essentially inextensible liner formed of four liner components, each liner component being of a similar, generally oval shape with inturned edges secured together and to an associated panel by stitching to form four seams, the liner components being located between the panels and the bladder, an opening formed centrally along a part of one seam at a location where the panels and liner components are not stitched; lacing located along the opening to couple the inturned edges in place of the stitching; closure means comprising two patches and a tongue located between the bladder and liner components, the patches being stitched to the liner components, the patches being stitched to the liner components and panels on opposite sides of the opening, the tongue being stitched to a liner component and panels and extending to a location between the bladder and patches; and a counter weight of a high density elastomeric material, and of a weight substantially equal to that of the lacing and closure means and molded to the bladder externally thereof along the seam of the panels opposite the lacing.

15 Claims, 1 Drawing Sheet

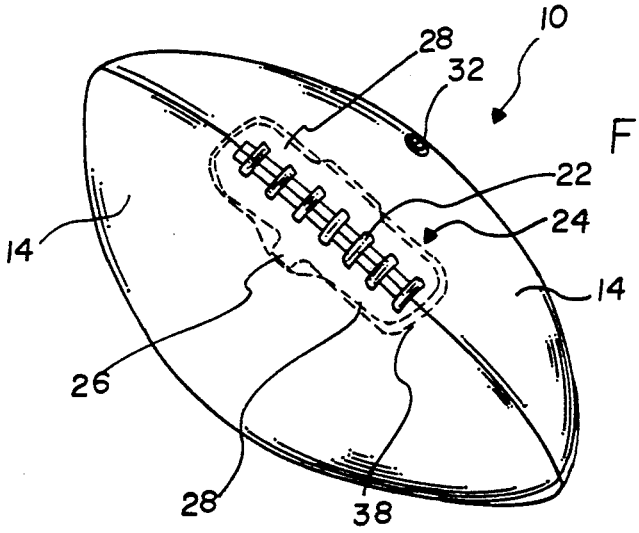
FIG. 1
FIG. 2
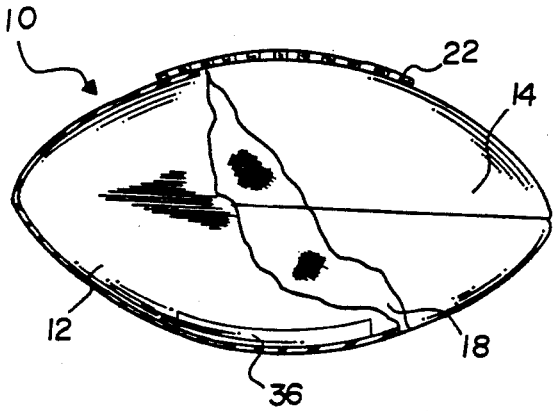
FIG. 3
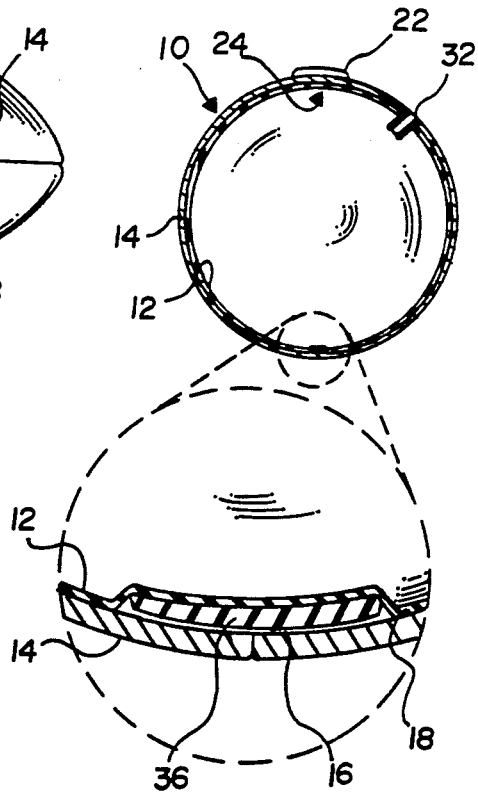
FIG. 4
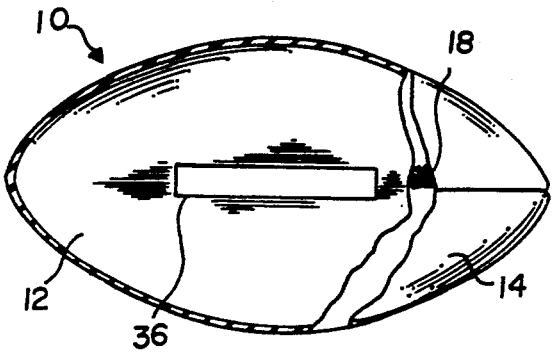

FOOTBALL

BACKGROUND OF THE INVENTION

1. Field of the Invention

This invention relates to a true spiral football and, more particularly, to a football of essentially conventional construction but with a weight patch formed interiorly of the panels at a location diametrically opposed from the lacing to eliminate the off center, rotational weight of the lacing and associated components when a spiral pass is thrown.

2. Description of the Background Art

Current American footballs are constructed with a one piece, inflatable, generally elliptically-shaped, bladder which is covered by four generally oval-shaped panels seamed together along their edges. One of the seams is not stitched along a central extent thereby forming an opening to allow the bladder to be inserted to within the panels during fabrication. After insertion, the opening is closed through lacing and associated components. As a result, a football is not symmetrically weighted around its periphery due to the concentration of weight in the area of the lacing. Consequently, when a pass is thrown which spirals about its longitudinal axis, the concentration of weight at the lacing results in rotational forces which cause the ball to move in other than a straight path of travel.

Footballs do not contain anything to promote the throwing of a true spiral pass. No additional components such as a weighting system has ever been placed within the construction of the panels of a football to stop the effect of the offset weight in the lacing area so as to facilitate a true spiral pass.

Various devices are commercially used or are disclosed in the patent literature for facilitating the true spiraling of footballs or for improving the seam area of balls, including footballs. By way of example, U.S. Pat. Nos. 3,884,466 and 4,003,574, both to McDonald, disclose techniques for throwing a true spiral. McDonald's footballs, however, rely upon a central longitudinal passage for improving flight characteristics. U.S. Pat. Nos., 3,475,027; 3,508,750 and 3,512,777, all to Henderson, disclose a game ball seam with raised areas and with inwardly directed depressions adjacent to the raised seams. Covering sections are provided on the surface of the ball between the seams. Nothing is directed to improving football spiraling. Other seaming arrangements are disclosed in U.S. Pat. Nos. 2,653,818 and 3,948,518 to Tibbits. But as in the Henderson patents, a multi-layer seam is placed at all seams thereby failing to counter-balance the single area of the lacing. Again, nothing is directed to improving football spiraling. Lastly, U.S. Pat. No. 4,462,590 to Mitchell discloses a game ball with padding and enlarged seams, the padding adapted to increase the holdability of the ball when throwing or catching. Once again, nothing is directed to improving football spiralling.

As evidenced by the above-referred to patents, as well as other commercial devices, a wide variety of devices have been designed with modifications in the seam or other areas for use in improving game balls or the ability to throw a spiral pass, but not of a conventional football. No prior patent or commercial device, however, is directed to a device as disclosed and claimed herein.

Accordingly, it is an object of the present invention to provide an American football comprising an inflatable, one piece bladder formed in a generally elliptical shape and fabricated of an elastomeric material; four panels secured together over the bladder, each panel being of a similar, generally oval shape with inturned edges secured together by stitching to form four seams; an essentially inextensible liner formed of four liner components, each liner component being of a similar, generally oval shape with inturned edges secured together and to an associated panel by stitching to form four seams, the liner components being located between the panels and the bladder; an opening formed centrally along a part of one seam at a location where the panels and liner components are not stitched; lacing located along the opening to couple the inturned edges in place of the stitching; closure means comprising two patches and a tongue located between the bladder and liner components, the patches being stitched to the liner components and panels on opposite sides of the opening, the tongue being stitched to a liner component and panel and extending to a location between the bladder and patches; and a counter weight of an elastomeric material, and of a size and shape substantially equal to that of the lacing and closure means molded to the bladder external thereof along the seam of the panels opposite the lacing.

It is a further object of the present invention to facilitate the throwing of true spiral passes with an American football.

It is a further object of the invention to place a weight inside the panels of a football to counter balance the nonsymmetrical weight caused by the lacing and associated components.

A further object of the present invention is to counteract the effects of the weight caused by components associated with the lacing region of the football.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention may be incorporated into an improved American football comprising an inflatable, one piece bladder formed in a generally elliptical shape and fabricated of an elastomeric material; four panels secured together over the bladder, each panel being of a similar, generally oval shape with inturned edges secured together by stitching to form four seams; an essentially inextensible liner formed of four liner components, each liner component being of a similar, generally oval shape with inturned edges secured together and to an associated panel by stitching to form four seams, the liner components being located between the panels and the bladder; an opening formed centrally along a part of one seam at a location where the panels and liner components are not stitched; lacing located along the opening to couple the inturned edges in place of the stitching; closure means comprising two patches and a tongue located between the bladder and line components, the patches being stitched to the liner components and panels on opposite sides of the opening, the tongue being stitched to a liner component and panels and extending to a location between the bladder and patches; and a counter weight of an elastomeric material, and of a size and shape substantially equal to that of the lacing and closure means molded to the bladder external thereof along the seam of the panels opposite the lacing.

The invention may also be incorporated into a football comprising a generally elliptical bladder, generally oval panels seamed thereover, lacing components along one seam and a counter weight secured along a seam thereof opposite the lacing.

The bladder is one piece and inflatable, formed in a generally elliptical shape and fabricated of an elastomeric material. The panels are of a similar, generally oval shape with inturned edges secured together by stitching to form four seams. The football further includes an essentially inextensible liner formed of four liner components, each liner component being of a similar, generally oval shape with inturned edges secured together and to an associated panel by stitching to form four seams, the liner components being located between the panels and the bladder. The football further includes an opening formed centrally along a part of one seam at a location where the panels and liner components are not stitched. The football further includes lacing located along the opening to couple the inturned edges in place of the stitching. The football further includes closure means comprising two patches and a tongue located between the bladder and liner components, the patches being stitched to the liner components and panels on opposite sides of the opening, the tongue being stitched to a liner component and panel and extending to a location between the bladder and patches. The counter weight is of an elastomeric material and of a size and shape substantially equal to that of the lacing and closure means and molded to the bladder external thereof along the seam of the panels opposite the lacing. The counter weight is elongated with a rectangular cross section. The counterweight is fabricated of an elastomeric material with a filler. The elastomeric material may be butyl rubber. The filler is a high density material such as barium sulfate or tungsten powder.

The invention may also be incorporated into a football comprising an inflatable, one piece bladder formed in a generally elliptical shape and fabricated of an elastomeric materials; panels secured together over the bladder, each panel being of a similar, generally oval shape with inturned edges secured together by stitching to form seams; an opening formed centrally along a part of one seam at a location where the panels are not stitched; closure means and lacing means located along the opening to couple the inturned edges in place of the stitching; and counter weight means secured interior of the panels of a size and shape correlated to that of the closure means and lacing means to effect the proper balance of the football when a spiral pass is thrown.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective illustration of a football, with certain internal parts shown in dotted line configuration to show certain internal constructions, the football including the weighting system adapted to carry out the principals of the present invention.

FIG. 2 is a sectional view of the football shown in FIG. 1 taken vertically along its longitudinal axis.

FIG. 3 is a sectional view of the football shown in FIG. 1 taken horizontally to its longitudinal axis, and with one portion in an enlarged showing.

FIG. 4 is a sectional view of the football shown in FIG. 1 taken perpendicularly to its longitudinal axis, and with one portion in an enlarged showing.

Similar reference characters refer to similar parts throughout the several views of the drawings.

DETAILED DESCRIPTION OF THE PREFERRED EMBODIMENT

Shown in the drawings with particular reference to FIG. 1, the present invention is illustrated as an American football 10. The American football 10 is a generally elliptically-shaped object with an elongated, longitudinal, central axis. It is constructed with an internal, generally elliptically-shaped bladder 12 and external, generally oval shaped panels 14 coupled together at their edges by stitches 16 and positioned over the bladder 12. Four essentially similarly shaped, generally oval shaped panels 14 are normally utilized with the panels 14 in abutment along their edges whereat their edges are inturned and stitched. An inextensible liner, formed of liner components 18, is located between the bladder 12 and the panels 14. The liner components 18 are of a generally oval configuration, corresponding in shape, size and number to the panels 14 to which they are stitched. Along one of the seams are lacing 22 and a closure assembly 24. The closure assembly 24 includes a tongue 26 and two patches 28. The lacing 22 and closure assembly 24 are used during fabrication as will be described in greater detail hereinafter. The final component of the football 10 is a valve 32. The valve 32 extends through a hole in the center of one panel 14 and in the bladder 12 for inflation and deflation purposes.

The purpose of the present invention is to use a weighting system to provide a truer spiral for a football 10 when thrown. Current footballs do not have a true spiral due to the offset weight which resides in the lacing area. The lacing area includes the lacing 22, the patches 28 stitched to the panels 14 and liner 11 under the lacing 22 and the tongue 26 between the bladder 2 and patches 28. The concept behind the present invention is to stop the wobble caused by the lacing area weight by offsetting it with a similar weight on the diametrically opposed side of the ball 10. This enables the ball 10 to spiral true around the center axis of the ball 10. The premise being that a ball that spirals truer will fly more accurately. The weighting is accomplished by applying a weight or a weight strip or patch 36, as of a high density filler, preferably of barium sulfate, a baryte, or a tungsten powder, in a polymer binder, such as butyl rubber, located internal to the football 10 of a proper size, shape and weight and at the proper and precise location.

The preferred bladder 12 weight patch 36 is a 6 by 1½ by ⅛ inch member of an elastomer such as a butyl rubber compound with barytes or tungsten powder for increased density. The patch 36 is 25 to 27 grams in weight, offsetting a similar weight caused by the increased weight of the lacing 22 and associated components, i.e., the tongue 26 and patches 28. The patch 36 is adhered to the bladder 12 in its production stage. The weight of the entire bladder 12 with weight patch 36 is 100 to 105 grams.

The preferred liner material is an inextensible material for shape retention, preferably a polyethylene mesh impregnated with polyvinyl chloride. The liner material preferably weighs 28 ounces per square yard plus or minus 2.0 ounces. The four liner components 18 are to be 28 to 30 grams each for a total component weight of 112–120 grams.

The preferred panels 14 are preferably a treated leather which can be split to as low as 0.060 to 0.063 inches to maintain the weight per panel 14 of 39.5 to 41.5 grams for a total weight of 158 to 166 grams for all the panels. The treating agent is a sticky substance which may be coated on the panels 14 but is preferably impregnated therein.

The preferred patches 28 are made up of either the leather or liner material with a total weight of the lacing 22 patches 28, two in number, being 8 to 11 grams.

The preferred tongue 26 is made of leather and weighs 9 to 10 grams.

The preferred lacing 22, whether comprised of one or two lacing 22, is leather or a synthetic leather substitute and weights 6 to 8 grams.

Such component materials of the football 10 are all commercially available from a variety of sources.

This lacing 22, tongue 26 and patches 28 are made up of various pieces that weigh 25 to 27 grams. They are of materials, sized and positioned to allow for the weight patch counter action. The entire football weight is 393 to 420 grams.

The components of the football 10 are assembled in the conventional manner. Specifically, except for the bladder 12 and weight patch 36, all ball components are first cut to size. The liner components 18 are then sewn to the panels 14 along their peripheries. The edges of the panels 14 and liner components 18 are then stitched together along their edges forming seams and creating a football-shaped shell for receiving a pre-molded bladder 12. The stitching is effected while their panels 14 and liner 18 are inside out. A central extent along one seam is not stitched to thereby form an opening 38 through which the bladder 12 may be passed during fabrication. The tongue 26 and patches 28 are then sewn into position to the panels 14 and liner 18 as shown in the Figures with the patches 28 spanning the opening 38. The tongue 26 is sewn to a panel 14 and liner 18 along a short extent offset slightly from the patches 28. The panels 14 and liner 18 are then turned outside out, and the bladder 12 is inserted. The bladder 12 is molded in one piece with a weight patch 36 along one edge. The weight patch 36 is positioned diametrically opposed from the opening 38 and lacing 22 between the panels 14 and the remainder of the bladder 12. The opening 38 is then closed by lacing 22 with the tongue 26 having its enlarged portion located between the bladder 12 beneath the lacing 22 and patches 28 thereabove.

The bladder 12 of the present invention is inserted into the carcass so that the weight patch 36 of the bladder 12 lines up in axial alignment with the bottom seam diametrically opposite from the lacing 22 of the ball 10. In this manner, the weight patch means 36 is oriented with respect to the remainder of the football for proper weight distribution to allow the throwing of a true spiral.

As used herein the terms "internal" and "external" as well as "over" and "under" are determined with respect to the radial direction when measured with respect to the central axis of the football.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An American football comprising:

an inflatable, one piece bladder formed in a generally elliptical shape and fabricated of an elastomeric material;

four panels secured together over the bladder, each panel being of a similar, generally oval shape with inturned edges secured together by stitching to form four seams;

an essentially inextensible liner formed of four liner components, each liner component being of a similar, generally oval shape with inturned edges secured together and to an associated panel by stitching to form four seams, the liner components being located between the panels and the bladder;

an opening formed centrally along a part of one seam at a location where the panels and liner components are not stitched;

lacing located along the opening to couple the inturned edges in place of the stitching;

closure means comprising two patches and a tongue located between the bladder and liner components, the patches being stitched to the liner component and panels on opposite sides of the opening, the tongue being stitched to a liner component and panel and extending to a location between the bladder and patches; and a counter weight of an elastomeric material, and of a weight substantially equal to that of said lacing and closure means and molded to the bladder externally thereof along the seam of the panels opposite said lacing.

2. A football comprising a generally elliptical bladder, generally oval panels seamed thereover, lacing components along one seam and a counter weight secured along a seam thereof diametrically opposite said lacing components and equal to the weight of said lacing components.

3. The football as set forth in claim 2, wherein the bladder is one piece and inflatable, formed in a generally elliptical shape and fabricated of an elastomeric material.

4. The football as set forth in claim 3, wherein the panels are of a similar, generally oval shaped with inturned edges secured together by stitching to form four seams.

5. The football as set forth in claim 4 and further including an essentially inextensible liner formed of four liner components, each liner component being of a similar, generally oval shape with inturned edges secured together and to an associated panel by stitching to form four seams, the liner components being located between the panels and the bladder.

6. The football as set forth in claim 5 and further including an opening formed centrally along a part of one seam at a location where the panels and liner components are not stitched.

7. The football as set forth in claim 4 and further including lacing located along the opening to couple the inturned edges in place of the stitching.

8. The football as set forth in claim 4 and further including closure means comprising two patches and a tongue located between the bladder and liner components, the patches being stitched to the liner components and panels on opposite sides of the opening, the tongue being stitched to a liner component and panel and extending to a location between the bladder and patches.

9. The football as set forth in claim 8 wherein the counter weight is of an elastomeric material and of a size and shape substantially equal to that of the lacing and closure means and molded to the bladder external thereof along the seam of the panels opposite the lacing.

10. The football as set forth in claim 9 wherein the counter weight is elongated with a rectangular cross section.

11. The football as set forth in claim 10 wherein the counterweight is fabricated of an elastomeric material with a high density filler material.

12. The football as set forth in claim 11, wherein the elastomeric material is butyl rubber.

13. The football as set forth in claim 12, wherein the filler is barium sulfate.

14. The football as set forth in claim 12 wherein the filler is tungsten powder.

15. A football comprising:

an inflatable, one piece bladder formed in a generally elliptical shape and fabricated of an elastomeric material;

panels secured together over the bladder, each panel being of a similar, generally oval shape with inturned edges secured together by stitching to form seams;

an opening formed centrally along a part of one seam at a location where the panels are not stitched;

closure means and lacing means located along the opening to couple the inturned edges in place of the stitching; and counter weight means secured interiorly of the panels and of a weight corresponding to that of the closure means and lacing means to symmetrically balance the football so that a non-wobbly spiral pass may be thrown.

* * * * *